US005448959A

United States Patent [19]

Nanthavong et al.

[11] Patent Number: 5,448,959

[45] Date of Patent: Sep. 12, 1995

[54] BELT DRIVE PULLER MECHANISM

[75] Inventors: Phounsavath Nanthavong, Elgin, Ill.; Donald J. Hicks, Lebanon, Mo.

[73] Assignee: Union Special Corporation, Huntley, Ill.

[21] Appl. No.: 223,640

[22] Filed: Apr. 6, 1994

[51] Int. Cl.[6] ..... D05B 27/14

[52] U.S. Cl. ..... 112/475.01; 112/318; 112/284; 112/475.17; 74/42; 74/117

[58] Field of Search ..... 112/318, 322, 303, 220, 112/284, 320, 262.1; 74/837, 42, 117

[56] References Cited

U.S. PATENT DOCUMENTS

| | | | |
|---|---|---|---|
| 2,494,888 | 1/1950 | Vesconte et al. . | |
| 2,514,261 | 7/1950 | Scheffey | 74/42 |
| 2,678,010 | 5/1954 | Pinkvoss . | |
| 2,730,977 | 1/1956 | Hayes et al. . | |
| 3,853,078 | 12/1974 | Marforio . | |
| 4,073,248 | 2/1978 | Marforio . | |
| 4,152,995 | 5/1979 | Klundt . | |
| 4,461,229 | 7/1984 | Angele et al. | 112/318 X |
| 4,996,934 | 3/1991 | Lue | 112/318 |

OTHER PUBLICATIONS

Union Special Catalog No. 95DM, Class 35800, High Speed Feed-Off-The-Arm Machines with Differential Feed.

Union Special Catalog No. 95W, Classes 35700, 35800, High Speed Feed-Off-The-Arm Machines.

*Primary Examiner*—Paul C. Lewis

*Attorney, Agent, or Firm*—Willian Brinks Hofer Gilson & Lione

[57] ABSTRACT

A workpiece puller mechanism for a sewing machine including a carrier including a feed shaft mounted thereon that supports a feed roller. The periphery of the feed roller is biased downwardly into engagement with the upper surface of the workpiece while the lower surface is engaged by the feed dogs. A puller housing is mounted on the sewing machine having a puller shaft rotatably mounted for rotation therein. Rotation of the puller shaft is imparted by a timing belt that overlies sprockets on the sewing machine main drive shaft and the puller shaft. The puller shaft carries a crank head that is connected by a connecting bar assembly to the input member of a one way clutch assembly. The one way clutch assembly provides drive in one direction only to the drive shaft for the feed roller.

15 Claims, 3 Drawing Sheets

BELT DRIVE PULLER MECHANISM

BACKGROUND OF THE INVENTION

This invention relates to sewing machines and particularly to an improved workpiece feeding mechanism of the type that imparts feeding action to both the top and bottom surfaces of the workpiece in timed relationship with the stitch forming mechanism.

For sewing operations involving fabrics, such as denim used in jeans that are difficult to feed and operations where the control of the fabrics layers relative to each other is critical, feeding devices that impart a feeding action to both the upper and lower surface of the workpiece are used. The drive mechanism for the upper surface feeder is a critical element of such a system. The upper surface feeder must be synchronized with the lower surface feeder and with the needle drive and must be intermittent so that movement to the fabric is imparted only when the needle is not penetrating the fabric. Another consideration that is important with respect to the upper surface feeder is that the operators view of the work area cannot be overly restricted. Operators of commercial sewing machines of this type spend long periods of time working at the machine and it is very important that their working conditions are favorable and will not cause undue fatigue. For this reason the feeding devices for imparting movement to the workpiece should be free of vibrations and have a tolerable noise level. The drive mechanism for the upper surface feeder cooperates with the conventional lower surface feed dog mechanism that is disposed beneath the presser mechanism.

A Union Special Corporation, class 35800 sewing machine includes mechanism for imparting a feeding action to both the upper and lower surfaces of the workpiece. In this machine the drive for the upper mechanism is derived from the main drive shaft through an eccentric and pitman that oscillates a bellcrank which is connected to an input clutch drive member through a connecting bar. The clutch imparts a drive motion, in one direction, to the drive mechanism for the upper surface feeder. This commercially available machine feeds fabric that is difficult to control and maintains accurate alignment of the layers of material, however the eccentric drive taken from the main drive shaft produces considerable vibrations and sound levels. The vibrations and sound level produced by the workpiece feeding mechanism of this machine, while tolerable, can be improved which not only improves the operator's working environment but also results in a more durable machine and a machine that requires less service. By eliminating the eccentric and pitman drive from the main shaft and replacing it with a belt drive the vibration level is greatly reduced, the lubrication task simplified and the durability of the machine is improved. The level of vibrations and sound that is present in the prior art machines is particularly undesirable in commercial sewing operations where poor working environment will reduce the time period that a machine operator can be productive at his or her work station. The reduction of vibrations and sounds, that are unpleasant to the sewing machine operator and adversely effect output, constitutes a very important and significant improvement to machines of this type. The constant vibrations produced by the prior art device also limits the devices useful life and has adverse effects on other components of the sewing machine. For the foregoing reasons, there is a need for a drive mechanism for the upper surface feeder of a machine of this type that will not produce undesirable vibrations and sounds.

SUMMARY OF THE INVENTION

The present invention is directed to a device that drives the upper surface feeder with resulting levels of vibrations and sound that provide an improved drive mechanism for the machine as well as greatly improved work environment for the machine operator. The apparatus comprises a timing belt for driving the upper surface puller device and an improved clutch mechanism and drive link assembly that can accommodate different stitch lengths. The one way roller clutches that are used contributes significantly to the reduction of noise and vibrations. The adjustments in the drive mechanisms to accommodate stitch provide a wider range of stitch adjustments and also easy access to accomplish the adjustments.

The puller drive of the present invention is more durable and provides a better working environment than the prior art devices. The present invention is directed to a drive for a puller mechanism and satisfies needs that are present in the prior art. A puller mechanism drive having features of the present invention comprises a carrier mounted on the presser roller bar that includes a feed shaft having the feed roller mounted thereon. The periphery of the feed roller is biased downwardly and is adapted to engage the upper surface of the workpiece while the lower surface is engaged by the feed dogs. A puller housing is mounted on the sewing machine and includes a puller shaft mounted for rotation therein. Rotation of the puller shaft is imparted by a timing belt that overlies sprockets on the sewing machine main drive shaft and the puller shaft. The puller shaft carries a crank head that is connected by a connecting bar assembly to the input member of a one way clutch assembly. The one way clutch assembly provides drive in one direction only to the drive shaft for the feed roller.

For the foregoing reasons there is a need for a drive mechanism for an upper surface feeder that produces a more acceptable level of vibrations and sound levels than that produces by current devices.

DETAILED DESCRIPTION OF THE PREFERRED EMBODIMENT

Figure 1:
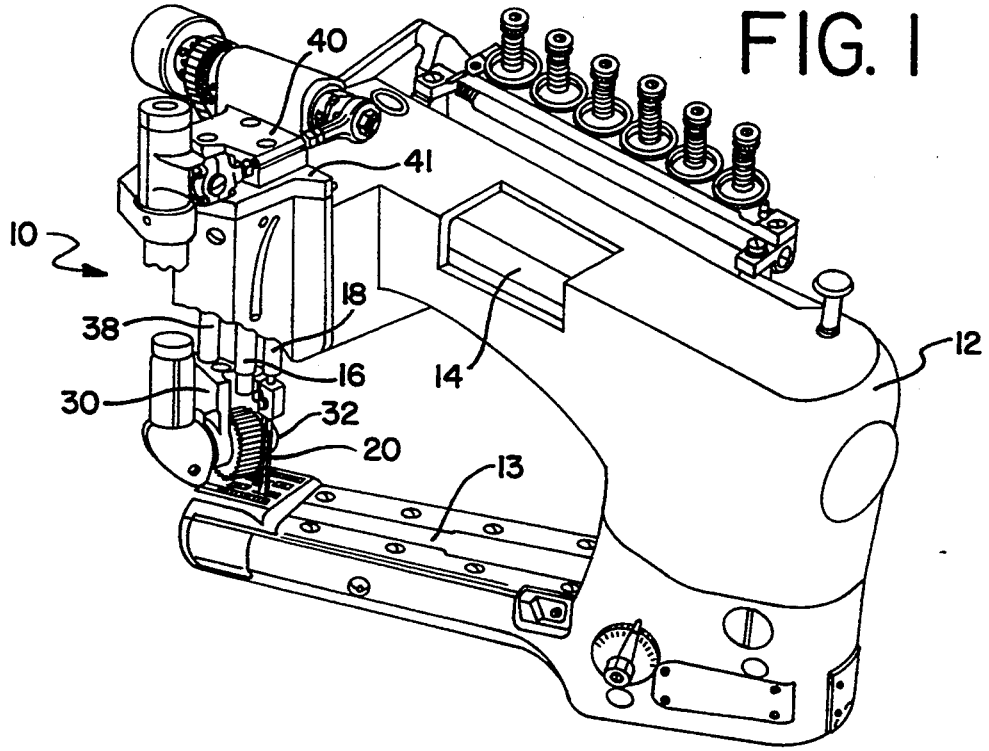
FIG. 1 shows a sewing machine, having portions of its housing broken away, to better show the embodiment of the invention that is mounted on the sewing machine.

There is shown in FIG. 1 a sewing machine 10 including a housing 12 having a work supporting arm 13. Power is supplied to the main shaft 14 through a drive sprocket 24 (see FIGS. 3 and 5) which is hidden from view in FIG. 1. A presser roller bar 16 is mounted in bearings, carried by housing 12, for vertical movement. A needle bar 18, also supported for vertical movement by bearings in housing 12, is connected to main shaft 14 by a conventional drive mechanism. A pair of needles 20 are shown carried at the lower end of the needle bar 18.

Figure 3:
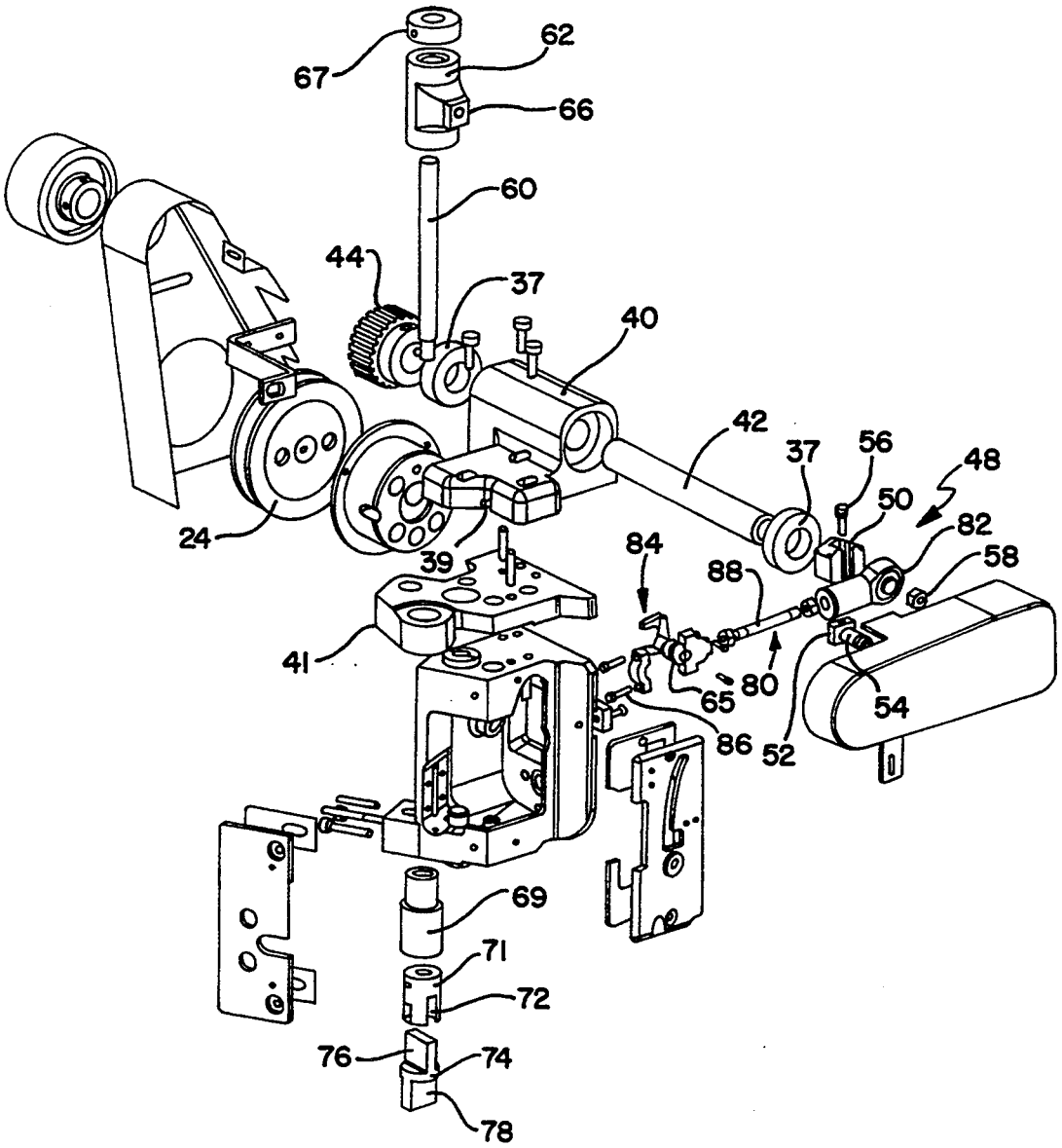
FIG. 3 is an exploded view of the embodiment of the invention seen in FIG. 2.
Figure 5:
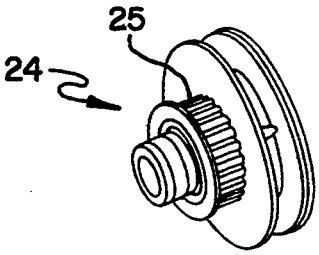
FIG. 5 is a perspective view of the opposite side of the driver sprocket from that seen in FIG. 3.

Drive sprocket 24, seen in both FIGS. 3 and 5, is driven by an external source of power such as an electric motor. As best seen in FIG. 5 drive sprocket 24 includes a timing belt driver sprocket 25.

A feed roller carrier 30 is secured to the lower end of the presser roller bar 16. The feed roller shaft 32, that carries the feed roller 34, is journaled in carrier 30. The periphery 36 of feed roller 34 has an aggressive feeding surface, formed by V-shaped groves, that engages the upper surface of the work during operation of the sewing machine. The lower end of a downwardly biased shaft 38 bears against carrier 30 causing the periphery 36 of feed roller 34 to be biased into engagement with the upper surface of the work piece.

A puller housing 40 is secured, for example by bolts 43, to a support plate 41 which is in turn precisely connected to the upper surface of the sewing machine housing 12. As can be best seen in FIG. 3, there is a keyway 39 formed in the bottom surface of puller housing 40 that receives the upper ends of studs that extend upwardly from support plate 41. The studs are dimensioned such that they fit in keyway 39 with very little clearance and function to insure that parallelism between the main shaft 14 and the puller shaft 42 is maintained when tensioning the timing belt 46. The puller housing 40 includes a pair of bearings 37 that support puller shaft 42 for rotation. Shaft 42 carries the driven sprocket 44 at one free end thereof. Driven sprocket 44 is vertically aligned with timing belt driver sprocket 25 and these sprockets are connected by timing belt 46. Sprockets 25 and 44 and timing belt 46 include engaging drive surfaces that insure that driven puller shaft 42 is driven in synchrony with main shaft 14. This drive provides for a very quiet, vibration free drive from the main shaft 14 to the puller shaft 42.

A crank head 48 is secured to the other free end of puller shaft 42. The crank head 48 is formed with a groove 50 that slidingly receives the head 52 of the crank pin 54. A locking bolt mechanism 56 is provided for fixing the location of the crank head 52 in the groove to thereby adjust the length of the crank or moment arm that extends from the center of puller shaft 42 to the center of crank pin 54. The free end of crank pin 54 is threaded to receive a nut 58 (see FIG. 2). The stitch length can be varied by use of the locking bolt 56. When the stitch length is changed by adjusting bolt 56 the length of the connecting bar assembly 80 should also be adjusted to maintain the center distance between the puller shaft and the input member 66 of the clutch assembly. By permitting adjustment of both the crank arm and the connecting bar assembly a wider range of stitch adjustment is made available. As can be best seen in FIG. 2 there is easy access to the crank arm and of the adjustment bar 88 for making stitch adjustments.

The connecting bar assembly 80 includes a bar end ball bearing 82 that slides over crank pin 54 and is secured in place by nut 58. The other end of connecting bar assembly 80 includes a ball joint 84 that can be secured by bolts 86 to a ball member 65 that is carried by the input member 66 of clutch drive housing 62. The opposite ends of connecting bar assembly 80 are connected by an adjustment bar 88 that permits adjustment of its length. As pointed out earlier the length of connecting bar assembly 80 must be changed when stitch length adjustments are made.

Figure 6:
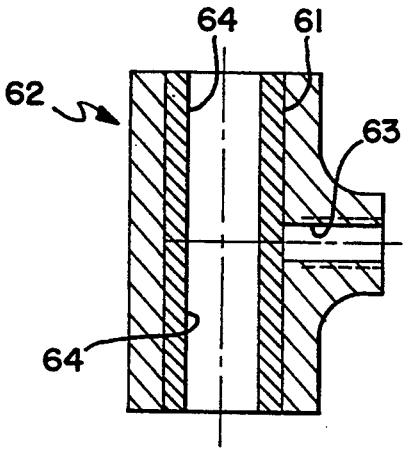
FIG. 6 is a cross sectional view of the clutch drive housing.

FIG. 6 is a cross section view of the clutch drive housing 62. Ball member 65 is threaded into the internally threaded bore 63 and a pair of roller clutches 64 are pressed into a longitudinal bore 61 formed in the clutch drive housing 62. Roller clutches 64 transmit torque in one direction, from the roller clutch to a shaft 60 extending through its center.

Figure 8:
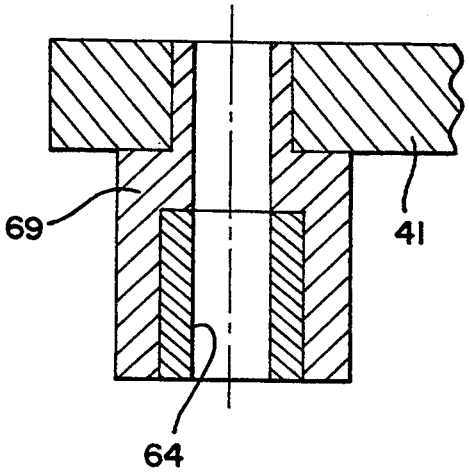
FIG. 8 is a cross section view of the support plate and clutch housing.

FIG. 8 is a cross section view through support plate 41 and clutch housing 69. The support plate 41 is stationary as is clutch housing 69 since it is press fitted into support plate 41. A roller clutch 64 is press fitted into the lower portion of clutch housing 69. It should be noted that although driven shaft 60 extends through the roller clutches 64 shown in FIGS. 6 and 8, shaft 60 is not illustrated in these views. The roller clutches 64, that are carried by clutch drive housing 62, function to transmit torque to drive shaft 60 when clutch drive housing 62 rotates in one direction and allows free overrun when the clutch drive housing 62 rotates in the opposite direction. The roller clutch 64, carried by clutch housing 69 functions as a clutch bearing that will permit shaft 60 to rotate in one direction but prevents its rotation in the opposite direction.

Figure 7:
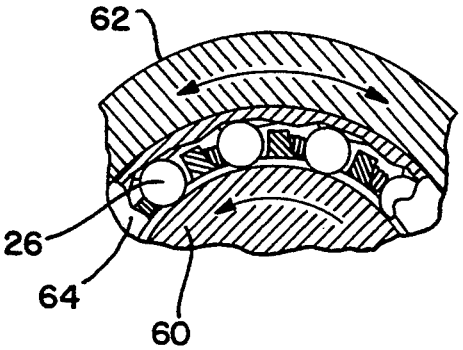
FIG. 7 is a cross section view of the clutch drive housing, roller clutch and the drive shaft.

FIG. 7 is a cross sectional view of the clutch drive housing 62, a roller clutch 64 with the drive shaft 60 in place within the roller clutch. In this illustration a double pointed arrow indicates that clutch drive housing 62 oscillates about its center. The roller clutch 64 is press fitted in clutch drive housing 62 and thus its outer race oscillates therewith. The roller clutch 64 includes a plurality of rollers 26 that ride down ramps formed in the outer race of the roller clutch 64 when the clutch drive housing 62 rotate counterclockwise. The movement of rollers 26 down the ramps force the rollers 26 toward the drive shaft 60 and locks the drive housing 62 to the drive shaft 60. When torque is being transmitted to shaft 60 the rollers 26 are functioning as the output member of the clutch. The single pointed arrow on drive shaft 60 indicates that it is driven in the counterclockwise direction only. When the direction of rotation of the clutch drive housing 62 is reversed, to the clockwise direction, the rollers ride up the ramps and move away from their locked position with shaft 60. This frees the clutch drive housing 62 and the roller clutch 64 from the drive shaft 60 and torque is not transmitted to the drive shaft 60. The use of this type of clutch reduces the noise and vibrations significantly and contributes to the overall objective of providing an improved puller drive that produces less noise and vibrations. When, the shaft 60 is being rotated in the counter-clockwise direction, the roller clutch 64 carried by clutch housing 69 will permit and not prevent rotation of shaft 60 in this direction. However, this roller clutch 64 would function to prevent rotation of shaft 60 in the clockwise direction. The roller clutches 64 used in the prototype used to develop this invention were commercially available products sold under the brand name TORRINGTON, however other commercially available clutches could be used. The roller clutches per se, were not invented by applicants.

The vertically orientated feed drive shaft 60 extends through the center of roller clutches 64 and is prevented from downward movement by a collar 67. When the clutch drive housing 62 is oscillated by the connecting bar assembly 80, rotary motion is transmitted to feed drive shaft 60 in one direction through the roller clutches 64. The lower end of feed drive shaft 60 extends through a clutch bearing housing 69 and has a drive mechanism for connecting the feed drive shaft 60 to the feed roller 32. The drive mechanism includes an upper feed roller connector 71 secured to the lower extremity of feed drive shaft 60. Upper feed roller connector 71 has slot 72 formed therein which receives the upper flange 76 of a floating connector 74. Floating connector 74 functions to transmit drive motion from upper feed roller connector 71 to lower feed roller connector 92 even when these elements are not aligned. The lower flange 78 of floating connector 74 fits into a slot 90 formed in lower feed roller connector 92 that carries a bevel gear at its lower end. The bevel gear on the lower end of lower feed roller connector 92 meshes with another bevel gear that is secured to feed roller shaft 32. This bevel gear drive is covered by a housing member 94.

Figure 4:
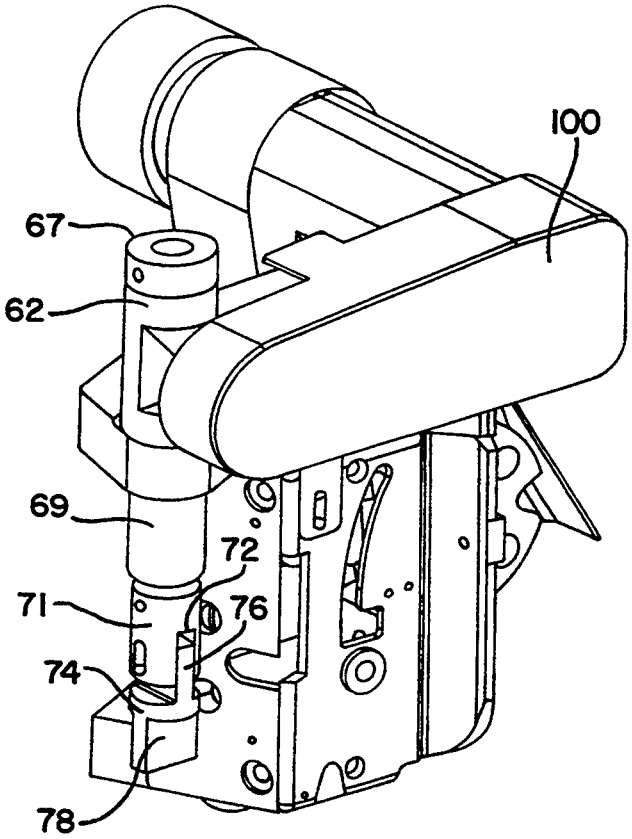
FIG. 4 is a view of a portion of the embodiment of the invention seen in FIG. 2 inclosing a housing member.

In FIG. 4 the drive mechanism for the upper surface feeder is shown assembled and a cover 100 is provided for the connecting bar assembly 80.

Figure 2:
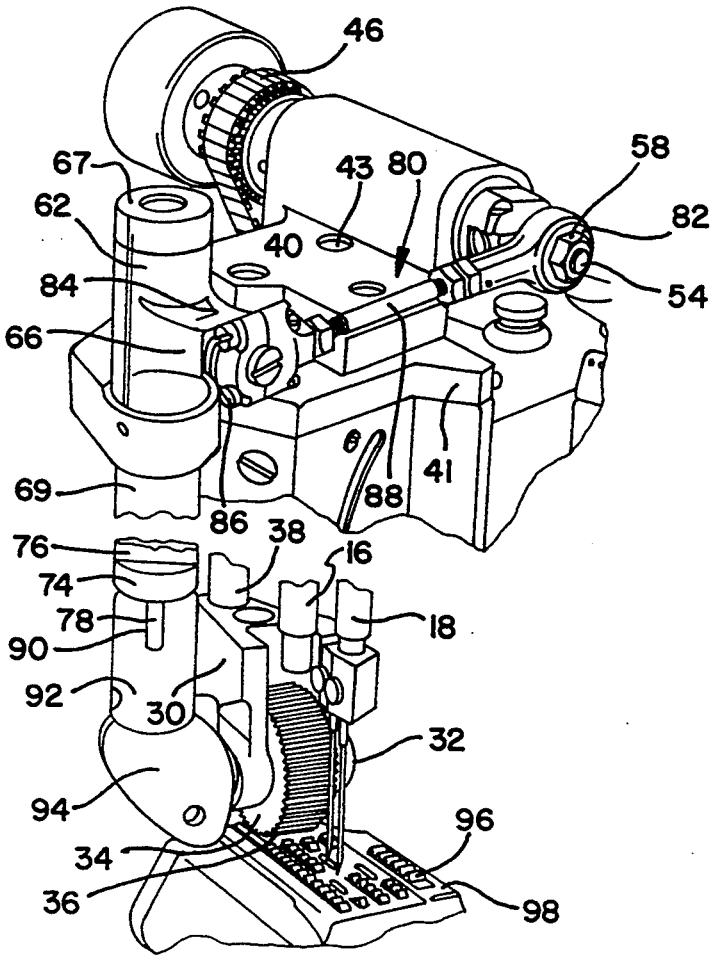
FIG. 2 is an enlarged view of the embodiment of the invention that is mounted on the sewing machine seen in FIG. 1.

The feed dogs 96 as best seen in FIG. 2 extend up through openings formed in the needle plate 98 and are driven in the conventional manner through a drive mechanism that extends from main shaft 14, down the vertical portion of the housing 12 and through the work supporting arm 13.

It is intended that the accompanying Drawings and foregoing detailed description is to be considered in all respects as illustrative and not restrictive, the scope of the invention is intended to embrace any equivalents, alternatives, and /or modifications of elements that fall within the spirit and scope of the invention, and all changes which come within the meaning and range of equivalency of the claims are therefore intended to be embraced therein.

What is claimed is:

1. In a sewing machine of the type having a housing, a main shaft rotatably mounted in the housing, a drive sprocket mounted on said main shaft, a presser roller bar mounted for upward and downward movement in said housing relative to the workpiece to be sewn, a needle bar and needle mounted for vertical reciprocation in said housing adjacent said presser roller bar, said needle bar being drivingly connected to the main shaft, wherein the improvement comprises:

a carrier mounted on said presser roller bar for movement therewith, a feed roller shaft journaled in said carrier, a feed roller mounted on said feed roller shaft and having a periphery that is adapted to engage the workpiece to be sewn, resilient mechanism for biasing said carrier downwardly into engagement with the workpiece to be sewn;

a puller housing mounted on said sewing machine housing, a puller shaft mounted for rotation in said puller housing, said puller shaft having a driven sprocket fixed thereto, a timing belt drivingly connecting said drive sprocket to said driven sprocket to impart rotary motion to said puller shaft in timed relationship with said main shaft, a crank head mounted on said puller shaft;

a vertically orientated feed drive shaft mounted on said sewing machine housing, a one way clutch assembly including input and output members, a connecting bar connecting said crank head to said input member of said clutch assembly for imparting an oscillating movement to said input member of the clutch assembly, said output member of the clutch assembly connected to said vertically orientated feed drive shaft and being effective to transmit one way rotary movement to said vertically oriented feed drive shaft, drive mechanism connecting said vertically orientated feed drive shaft to said feed roller shaft such that said feed roller will advance the workpiece in the direction of material feed only when the needles are withdrawn from the workpiece.

2. The invention as set forth in claim 1, wherein said crank head includes a crank pin, said crank pin being adjustably secured to said crank head to vary the length of the crank arm which results in a change in the stitch length.

3. The invention as set forth in claim 1, wherein said one way clutch assembly includes:

a cylindrical shaped housing having a longitudinal bore and said input member for imparting reciprocal movement thereto, a cylindrical shaped roller clutch member secured to said cylindrical shaped housing within said longitudinal bore for reciprocal movement therewith, said cylindrical shaped roller clutch member including said output members that extend radially inwardly when the cylindrical shaped housing is rotated in one direction;

and wherein said vertically orientated feed drive shaft extends through said cylindrical shaped roller clutch and is locked thereto for rotation therewith when said clutch output members extend inwardly as a result of rotation of the cylindrical shaped housing in said one direction.

4. The invention as set forth in claim 2 wherein said connecting bar includes an adjustment bar for varying the length of said connecting bar to maintain the center distance constant between the crank pin and the clutch input member when adjustments for stitch length are made.

5. The invention as set forth in claim 2, wherein said crank pin includes a mounting head and said crank head has a slot formed therein that is adapted to slidingly receive the mounting head of said crank pin, and locking mechanism for securing the crank pin in a selected location along the slot formed in said crank head.

6. The invention as set forth in claim 4, wherein said crank pin includes a mounting head and said crank head has a slot formed therein that is adapted to slidingly receive the mounting head of said crank pin, and locking mechanism for securing the crank pin in a selected location along the slot formed in said crank head.

7. In a sewing machine of the type having a main drive shaft, a work supporting surface having a needle plate, a needle carried by a reciprocating needle bar and a presser roller carrier having a feed roller shaft journalled therein and a feed roller carried thereby for contact with the upper layer of the work, said feed roller operatively associated with a feed dog that extends upwardly through the needle plate and functions to pull a plurality of layers of work to the needle for the formation of stitches therein, wherein the improvement comprising:

drive mechanisms interconnecting the main drive shaft with said feed roller shaft for effecting intermittent rotation of the feed roller;

said drive mechanisms including a puller shaft having a driven sprocket secured thereto, a driving sprocket carried by said main drive shaft, and a timing belt drivingly connecting said driving sprocket to said driven sprocket to provide positive vibration free, quiet drive from said main shaft to said puller shaft and insure that the puller shaft remains in phase with the main drive shaft, a one way clutch having input and output members, a drive mechanism, that converts rotary motion to oscillating motion, extending from said puller shaft to said input member of the one way clutch, such that the output member of the one way clutch rotates intermittently in one direction, said output member of the one way clutch being drivingly connected to said feed roller shaft for providing intermittent rotatory motion to said feed roller.

8. The invention as set forth in claim 7, wherein said drive mechanism includes a crank head having a crank pin, said crank pin being adjustably secured to said crank head to vary the length of the crank arm which results in a change in the stitch length.

9. The invention as set forth in claim 7, wherein said one way clutch assembly includes:

a cylindrical shaped housing having a longitudinal bore and said input member for imparting reciprocal movement thereto, and a cylindrical shaped roller clutch member secured to said cylindrical shaped housing within said longitudinal bore for reciprocal movement therewith, said cylindrical shaped roller clutch member including said output members that extend radially inwardly when the cylindrical shaped housing is rotated in one direction;

and wherein a vertically orientated feed drive shaft extends through said cylindrical shaped roller clutch and is locked thereto for rotation therewith when said clutch output members extend inwardly as a result of rotation of the cylindrical shaped housing is said one direction.

10. The invention as set forth in claim 8 wherein said drive mechanism further includes a connecting bar assembly which includes an adjustment bar for varying the length of said connecting bar to maintain the center distance constant between the crank pin and the clutch input member when adjustments for stitch length are made.

11. The invention as set forth in claim 8, wherein said crank pin includes a mounting head and said crank head has a slot formed therein that is adapted to slidingly receive the mounting head of said crank pin, and locking mechanism for securing the crank pin in a selected location along the slot formed in said crank head.

12. The invention as set forth in claim 10, wherein said crank pin includes a mounting head and said crank head has a slot formed therein that is adapted to slidingly receive the mounting head of said crank pin, and locking mechanism for securing the crank pin in a selected location along the slot formed in said crank head.

13. The method of intermittently pulling work material to be stitched to the stitch forming mechanisms of a sewing machine comprising the steps of:

(a) biasing a feed roller downwardly into contact with the upper surface of the work material;

(b) raising the feed dog into engagement with the bottom surface of the work material and then moving the feed dog in a direction that will pull work material toward the stitch forming mechanisms of the sewing machine;

(c) transmitting rotary motion from the main drive shaft of the sewing machine to a puller shaft through a timing belt and sprockets;

(d) converting the rotary motion of the puller shaft to oscillating motion of a crank mechanism and transmitting oscillating motion to the input member of a one way clutch from the crank mechanism;

(e) transmitting intermittent rotary drive motion in one direction from the output member of the one way clutch to the feed roller in a direction to cooperate with pulling the work material toward the stitch forming mechanism, after the feed dog has been raised into engagement with the bottom surface of the work material and while the feed dog is moving in a direction that will pull the work material toward the stitch forming mechanism.

14. The method as set forth in claim 13 including the additional step of:

(f) changing the length of a stitch to be formed by adjusting the length of a crank arm of said crank mechanism.

15. The method as set forth in claim 14 including the additional step of:

(g) maintaining the center distance constant between a crank pin of the crank mechanism and the clutch input member when adjustments are made to the stitch length.

* * * * *